United States Patent [19]

Stotler

[11] Patent Number: 4,783,865

[45] Date of Patent: Nov. 15, 1988

[54] INFANT NESTLING BARRIER

[76] Inventor: James G. Stotler, 16 SE. 50th Ave., Portland, Oreg. 97215

[21] Appl. No.: 880,181

[22] Filed: Jun. 30, 1986

[51] Int. Cl.[4] ..... A47C 27/08

[52] U.S. Cl. ..... 5/424; 5/508; 5/431

[58] Field of Search ..... 5/431, 434–437, 5/442, 424, 93 R, 508

[56] References Cited

U.S. PATENT DOCUMENTS

| | | | |
|---|---|---|---|
| 2,167,622 | 8/1939 | Bentivoglio | 5/434 |
| 2,522,120 | 9/1950 | Kaskey et al. | 5/436 |
| 3,609,778 | 10/1971 | Zeiner | 5/436 |
| 3,842,453 | 10/1974 | Redfield | 5/436 |
| 4,124,908 | 11/1978 | Burns et al. | 5/434 |
| 4,345,347 | 8/1982 | Kantor | 5/436 |

FOREIGN PATENT DOCUMENTS

| | | | |
|---|---|---|---|
| 1031814 | 6/1966 | United Kingdom | 5/436 |

*Primary Examiner*—Michael F. Trettel

*Attorney, Agent, or Firm*—Dellett, Smith-Hill and Bedell

[57] ABSTRACT

A nestling barrier for an infant includes a block of soft material having a U-shaped recess in one side thereof suitable for receiving and sheltering the head of an infant in the recess, to give the infant the comfort and security of close head confinement. Weight is embedded inside the block of soft material to impede movement of the barrier by the snuggling infant.

14 Claims, 1 Drawing Sheet

INFANT NESTLING BARRIER

BACKGROUND OF THE INVENTION

This invention relates to a sleeping aid for an infant, and particularly to a cushioned nestling barrier against which the infant may snuggle.

Infants placed in a crib to sleep often will exhibit, apparently instinctively, an urge to seek a side or corner of the crib to nestle and press against with their head, before sleeping, because they long for the comfort and security of close head confinement. Such a self-cradling urge may be associated with prenatal environment, and is termed herein, "nestling instinct." If crib pads are not installed on the sides of the crib, or if the infant is placed on a bed without sides, the infant may squirm and creep to the edge and fall from the bed or become wedged between the vertical members of the crib rails while attempting to satisfy the nestling instinct. Most authorities agree that satisfying an infant's natural preference for a comfortable sleep position is better than trying to establish or force another particular position advocated in the infant literature.

SUMMARY OF THE INVENTION

A cushioned, pillow-like barrier is provided for emplacement adjacent to the head of a reposing infant. The barrier includes a recess or nook formed in a substantially vertical anterior wall thereof for abutting and partially confining the head of the infant, thereby satisfying the nestling instinct of the infant. The barrier is weighted to inhibit easy movement of the device by the infant, while permitting it to be repositioned easily and conveniently on the sleeping surface by an attending person. In a preferred embodiment of the present invention, the recess is essentially U-shaped, having a configuration in cross-section of a trapezoid open at the base, thereby providing three points of contact for the head of the infant. The posterior surface of the nestling barrier may be an essentially flat vertical surface that abuts a wall of a crib.

It is therefore a principal object of the present invention to provide an improved sleeping aid for an infant.

It is another object of the present invention to provide an improved sleeping aid for satisfying the nestling instinct of an infant.

A further object of the present invention is to provide an improved cushioned barrier device having a recess for receiving the head of a sleeping infant snugly therein.

Yet another object of the present invention is to provide an improved cushioned barrier device for emplacement in the crib of an infant, whereby the infant may snuggle against the device.

A still further object of the invention is to provide an improved sleeping aid for an infant against which the infant may snuggle without easily moving the device.

DRAWING

While the invention is set forth with particularity in the appended claims, other objects, features, the organization and method of operation of the invention will become more apparent, and the invention will best be understood by referring to the following detailed description in conjunction with the accompanying drawings in which:

DESCRIPTION OF THE PREFERRED EMBODIMENT

Figure 1:
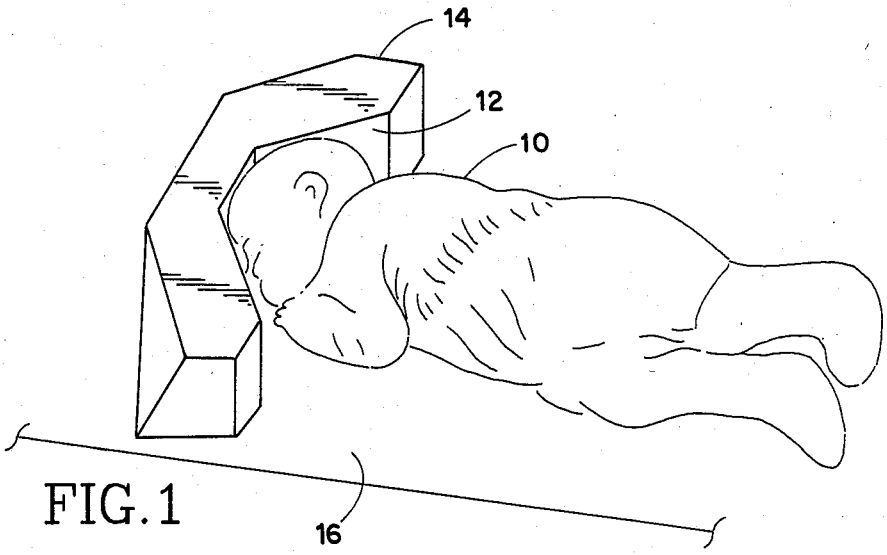
FIG. 1 is a pictorial view of an infant snuggling against a nestling barrier according to the instant invention.

Referring now to the various views of the drawings for a more detailed description of the components, materials construction, function, operation and other features of the instant invention by characters of reference, FIG. 1 illustrates an infant 10 nestling its head into a recess or nook 12 formed in a cushioned nestling barrier 14 placed adjacent the infant on a sleeping surface 16 such as the mattress of a crib on which the infant reposes. The infant's head, so emplaced adjacent the nestling barrier 14 and sheltered in the recess 12 thereof, is said to be nestled. The term "nestle" is used herein specifically to mean protect and shelter, without necessarily providing support and cover.

Referring to FIGS. 2–5, the nestling barrier 14 comprises a block 18 of soft foam material which suitably may be polyurethane foam or foam rubber, having substantially vertical sides 20, 22, posterior wall 24, and anterior wall 26, the latter including the recess or nook 12 of a size suitable for receiving the head of an infant therein, when the nestling barrier is placed on the sleeping surface 16. The block 18 is truncated at intersections of each of the sides 20, 22 with a top surface 28 and the posterior wall 24 to form a pair of diagonal triangular surfaces 30, 32. The top surface 28 of the block thus truncated is easily distinguishable from the bottom surface 34, a useful feature in a darkened room.

Figure 2:
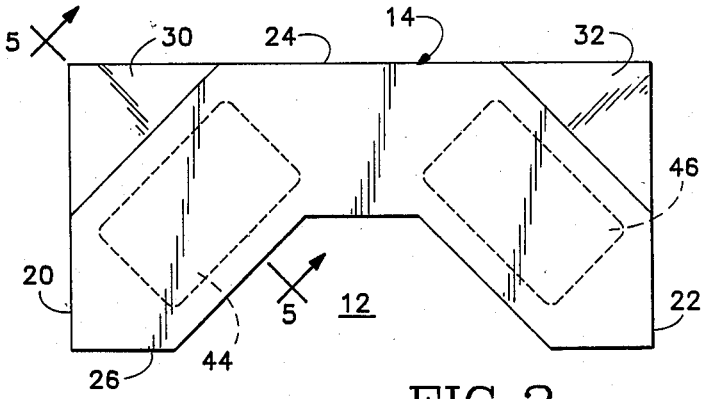
FIGS. 2, 3 and 4 are, respectively top, side elevation and front elevation views of the infant nestling barrier of FIG. 1.
Figure 3:
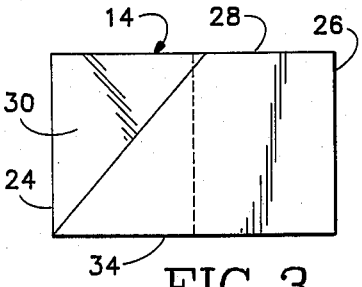

The recess 12 subtends the anterior wall 26 and extends into the block 18 about one half of the distance between the anterior 26 and posterior 24 walls. Although the recess 12 is illustrated in FIG. 2 in the shape of a trapezoid open at the base, it is understood that the recess 12 may suitably be semi-circular or rectangular in shape. The open trapezoidal shape with three flat surfaces provides three points of contact for the head of the infant and is a preferred embodiment of the invention because the shape simulates the shape of the human pelvis and thus emulates the prenatal environment. The block 18 thus forms the body of the substantially U-shaped nestling barrier 14 against which the infant snuggles, the head of the infant touching the anterior wall of the block at three points inside the recess 12 to give the infant the comfort and security of close head confinement.

The posterior surface 24 of the nestling barrier 14 is an essentially flat vertical wall suitable for abutting a wall or side rail of a crib.

A cover 40 encloses the block of foam 18, and may suitably be made of a soft material such as combed cotton or cotton flannel sewn together at the intersections of the block surfaces. A bottom surface 34 of the cover may be a bristly or flocked material selected to impede sliding of the snuggling device 14 on the surface 16.

Figure 5:
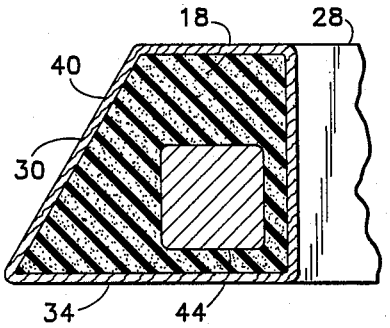
FIG. 5 is a view taken along line 5—5 of FIG. 2.
Figure 4:
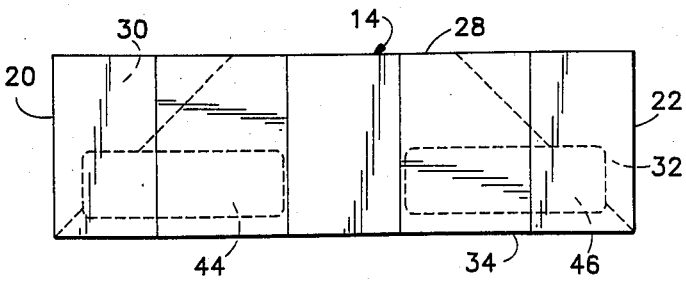

Referring to FIGS. 2, 4 and 5, weights 44, 46 are embedded in the foam block 18 to increase the weight of the snuggling device 14, and thereby further impede sliding of the device with respect to the surface 16 when the infant snuggles into the recess 12 and against the device 14. The weights 44, 46 may suitably be made of any dense, preferably pliable material such as metallized plastic, bagged sand or the like. While two weights 44, 46 are shown, it is evident that a single, more extensive weight may be utilized. The weights 44, 46 are surrounded on all sides thereof by a substantial thickness of the soft foam material of the block 18, and are situated closer to the bottom surface 34 than to the top 28 so as to improve vertical stability.

The cushioned nestling barrier of the present invention can be used in a crib or playpen to satisfy the nestling instinct of an infant and help the infant go to sleep faster. Babies enjoy the comfort of close head confinement provided by the nestling barrier and consequently will remain in the center of the crib and will not squirm or creep from udner blankets or push their heads against hard crib sides.

While the principles of the invention have now been made clear in the foregoing illustrative embodiment, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of the invention.

I claim:

1. A nestling barrier adapted to be placed on a surface on which an infant reposes, said nestling barrier comprising:

a block of soft material having a substantially flat bottom surface and a substantially vertical anterior surface, a substantially U-shaped recess in said block of soft material subtending the anterior surface, the recess being of a size suitable for receiving the head of the reposing infant therein and touching the top of the infant's head while extending part way around the infant's head, and a weight embedded in said block of soft material, said weight being sufficient to impede movement of said nestling barrier by the infant along the surface, said weight being substantially dense with respect to said soft material and surrounded by a substantial thickness of said soft material, said weight being disposed closer to a bottom surface of the nestling barrier than to a top surface of the nestling barrier.

2. A nestling barrier for an infant, comprising:

a block of soft material having a recessed wall shaped to receive and nestle the head of a reposing infant, said block of soft material being in the shape of a rectangular solid, said recessed wall being an anterior wall, said block having a substantially flat top surface, substantially vertical sides and a substantially vertical posterior wall, said block being truncated at intersections of each of the sides with the top surface and the posterior wall, whereby the truncated surfaces facilitate tactile identification of the top surface of the nestling barrier in a darkened room, and a weight embedded in said block of soft material to impede movement of said nestling barrier by the infant, said weight being surrounded by a substantial thickness of said soft material.

3. The nestling barrier of claim 2 comprising a cover enclosing said block of soft material.

4. The nestling barrier of claim 2 wherein said block of soft material includes a flat, bristly bottom surface to impede sliding of said nestling barrier.

5. The nestling barrier of claim 2 wherein said recess is essentially U-shaped.

6. The nestling barrier of claim 5 wherein said U-shaped recess includes three substantially flat sides.

7. The nestling barrier of claim 5 wherein said recess has a horizontal cross-sectional shape of a trapezoid with an open base.

8. A nestling barrier for an infant, comprising:

a block of soft material having a recessed wall shaped to receive and nestle the head of a reposing infant, and a weight embedded in said block of soft material to impede movement of said nestling barrier by the infant, said weight being surrounded by a substantial thickness of said soft material, said weight being disposed closer to a bottom surface of the nestling barrier than to a top surface of the nestling barrier.

9. The nestling barrier of claim 8 wherein said block of soft material includes a substantially flat posterior wall opposite said recessed wall.

10. The nestling barrier of claim 8 wherein said block of soft material includes a flat, bristly bottom surface to impede sliding of said nestling barrier.

11. The nestling barrier of claim 8 wherein said recess is essentially U-shaped.

12. The nestling barrier of claim 11 wherein said recess has a horizontal cross-sectional shape of a trapezoid with an open base.

13. The nestling barrier of claim 11 wherein said U-shaped recess includes three substantially flat sides.

14. The nestling barrier of claim 8 comprising a cover enclosing said block of soft material

* * * * *